US005879743A

United States Patent [19]

Revankar

[11] Patent Number: 5,879,743

[45] Date of Patent: Mar. 9, 1999

[54] METHOD FOR HARDFACING A METAL SURFACE

[75] Inventor: Gopal S. Revankar, Moline, Ill.

[73] Assignee: Deere & Company, Moline, Ill.

[21] Appl. No.: 955,170

[22] Filed: Oct. 21, 1997

Related U.S. Application Data

[63] Continuation of Ser. No. 697,667, Aug. 28, 1996, abandoned.

[51] Int. Cl.[6] ..... B05D 3/02

[52] U.S. Cl. ..... 427/191; 427/192; 427/195; 427/309; 427/374.3; 427/374.4; 427/376.1; 427/376.3; 427/376.8; 427/377; 427/380; 427/383.7; 427/385.5; 427/398.1; 427/422; 427/447; 427/456

[58] Field of Search ..... 427/447, 455, 427/456, 191, 192, 195, 309, 374.3, 374.4, 376.1, 376.3, 376.8, 377, 380, 383.7, 385.5, 398.1, 422

[56] References Cited

U.S. PATENT DOCUMENTS

| | | | |
|---|---|---|---|
| Re. 217,851 | 12/1941 | Alessi | 106/1 |
| 3,310,870 | 3/1967 | Parikh et al. . | |
| 4,175,163 | 11/1979 | Ikeno et al. . | |
| 4,625,810 | 12/1986 | Edmission | 172/749 |
| 4,682,987 | 7/1987 | Brady et al. | 51/293 |
| 4,954,058 | 9/1990 | Revankar | 419/18 |
| 5,027,878 | 7/1991 | Revankar et al. | 164/98 |
| 5,126,104 | 6/1992 | Anand et al. | 419/12 |
| 5,267,600 | 12/1993 | Revankar | 164/97 |
| 5,288,353 | 2/1994 | Revankar | 156/153 |
| 5,299,620 | 4/1994 | Revankar et al. | 164/97 |
| 5,383,513 | 1/1995 | Revankar | 164/97 |
| 5,443,916 | 8/1995 | Revankar | 428/539.5 |
| 5,456,323 | 10/1995 | Hill | 172/721 |

FOREIGN PATENT DOCUMENTS

| | | |
|---|---|---|
| 0 459 637 | 12/1991 | European Pat. Off. . |
| 60-89503 | 5/1985 | Japan . |
| 60-89504 | 5/1985 | Japan . |

OTHER PUBLICATIONS

Colmonoy Alloy Selector Chart, Copyright: Wall Colmonoy Corp. (1995) (No month avail.).

Hauser, H.H. and Mal, M.K., *Handbook of Powdered Metallurgy*, 2nd Ed. (especially starting at p. 22), Chemical Publishing Co., Inc., New York, New York, (1982) (No month avail.).

*Heat Treating Handbook*, vol. 4, ASM International, Metal Park, OH (1991) (No month avail).

Patent Abstracts of Japan, JP 60 089503, May, 1985.

Patent Abstracts of Japan, JP 60 089504, May 1985.

Shanefield, D.J., "Organic Additives and Ceramic Processing with Applications in Powder metallurgy, Ink, and Paint," p.255–279, May, 1995.

*Primary Examiner*—Bernard Pianalto
*Attorney, Agent, or Firm*—Burns, Doane, Swecker & Mathis, L.L.P.

[57] ABSTRACT

A wear-resistant hardfacing and a method for applying such a hardfacing is taught herein. A finely powdered, wear-resistant alloy and a polyvinyl alcohol (PVA) solution slurry is coated onto the metal surface of a tool, implement, or similar item to be hardfaced. Alternatively, a binding coating of PVA solution may be applied to the metal surface followed by application of a layer of a powdered alloy. After the slurry or PVA binding coating has dried, leaving a dry coat of alloy in a PVA matrix, the metal surface is heated to the fusion temperature of the alloy in vacuum, in an inert gas atmosphere, or in hydrogen atmosphere. The metal item with the fused coating is heat treated to impart desired mechanical properties to the part substrate material. The method of the present invention gives a smooth, dense coating of the wear-resistant hardfacing without nonmetallic inclusions.

13 Claims, No Drawings

METHOD FOR HARDFACING A METAL SURFACE

This application is a continuation of application Ser. No. 08/697,667, filed Aug. 28, 1996 abandoned.

BACKGROUND OF THE INVENTION

The present invention relates to a method of coating a metal surface, such as the metal surface of a tool or an agricultural implement, with a hard, wear-resistant coating.

Coating a metal surface with another metal or metal alloy to enhance appearance, protect against corrosion, or improve resistance to wear is well known in the art of metallurgy. Coating tools, particularly cutting edges of tools, with a hard, wear-resistant alloy is a common industrial practice, especially in the art of agricultural implement fabrication, and is often referred to as "Hardfacing" or "hard surfacing." For example, see Alessi, U.S. Pat. No. Re. 27,852, Revankar U.S. Pat. No. 5,027,878 and No. 5,443,916, Brady, et al., U.S. Pat. No. 4,682,987, and Hill U.S. Pat. No. 5,456,323.

Hardfacing is often done by fusing a powdered, hard metal alloy onto a metal surface. Typically, this method involves coating the metal surface with an aqueous slurry of a powdered, homogeneous alloy, a powdered flux, a binding agent, and a suspension agent; drying the slurry to form a solid layer; and heating the metal surface to a sufficiently high temperature to fuse the alloy onto the surface. The flux is to protect the alloy from reacting with the gases in the fusing furnace atmosphere while the alloy is being heated. The suspension agent promotes a uniform slurry. The binder holds the alloy and flux powders in place until the alloy slurry has dried onto the metal surface.

One problem with this method of hardfacing is that the flux, binder and suspension agent additives in the slurry remain in the fused coating as undesirable nonmetallic inclusions, and reduce the volume of effective wear-resistant coating for a given coating thickness. These inclusions are discontinuities in the coating that increase its brittleness and thus promote coating material removal by fracture, rather than abrasive wear, resulting in premature wear and shorter wear life of the coating.

Another problem with the methods of the art is nonuniformity of coating thickness. There are two reasons of this problem. 1) The slurry application allows the slurry to flow, when wet, on vertical and sloping surfaces thus forming an uneven distribution of the powdered alloy. 2) The flux/binder mixture used in the coating slurry melts ahead of the coating powder, and the resulting liquid tends to displace the powder particles on vertical and sloping surfaces and non-uniformly distribute them before the alloy powder begins to fuse.

It is an object of the present invention to provide a method for uniformly hardfacing a metal surface with a wear-resistant alloy with substantially no nonmetallic inclusions. A second object is to provide a slurry of wear-resistant alloy for use in hardfacing.

SUMMARY OF THE INVENTION

A first aspect of the present invention is a method for hardfacing a metal surface with a wear-resistant coating. A first embodiment of the method comprises the steps of:

a) forming a substantially uniform aqueous slurry of polyvinyl alcohol and a fusible, hard metal alloy in the form of a finely divided powder;

b) coating the metal surface with the aqueous slurry;

c) drying the aqueous slurry to leave a solid layer of the fusible, hard metal alloy in a polyvinyl alcohol matrix on the metal surface;

d) beating the metal surface coated with the layer of fusible, hard metal alloy in the polyvinyl alcohol matrix to the fusing temperature of the alloy under a protective atmosphere until the alloy has fused onto the metal surface; and e) cooling the metal surface with the fused hardfacing to ambient temperature.

Steps b and c may be repeated one or more times to build up a thicker coat of the alloy/polyvinyl alcohol matrix.

A second embodiment of the method for hardfacing a metal surface comprises the steps of:

a) coating the metal surface with an aqueous polyvinyl alcohol solution;

b) distributing a substantially uniform layer of a fusible, hard metal alloy in the form of a finely divided powder onto the coating of the polyvinyl alcohol solution applied in step b before the polyvinyl alcohol solution dries;

c) drying the aqueous polyvinyl alcohol solution coating to form a solid layer of the fusible, hard metal alloy bonded to the metal surface by the coating of polyvinyl alcohol;

d) heating the metal surface coated with the layer of fusible, hard metal alloy bonded by the coating of polyvinyl alcohol to the fusing temperature of the alloy in a protective atmosphere until the alloy has fused; and e) cooling the metal surface with the fused hardfacing to ambient temperature.

Steps a, b, and c may be repeated one or more times to build up layers of alloy each bonded to the layer below it by a coating of polyvinyl alcohol with the lowest layer being bonded directly to the metal surface.

A second aspect of the present invention is an aqueous slurry of polyvinyl alcohol and a fusible, hard metal alloy in the form of a finely divided powder used in the first embodiment of the method. Preferably the average particle size of the alloy is about 200 mesh or finer.

Wear-resistant coatings applied by the present slurry coating methods for hardfacing are uniformly dense and contain substantially no inclusions unlike slurry coatings applied by methods of the art. Hence the coatings of the present invention are less brittle and are more durable than coatings applied by methods of the art.

DETAILED DESCRIPTION OF THE INVENTION

A widely practiced method of hardfacing metal surfaces, particularly agricultural implements, is taught by Alessi in U.S. Pat. No. Re. 27,851. (incorporated herein by reference). This method comprises: a) preparing an aqueous slurry of a powdered hard alloy, a binder and a flux; b) coating the slurry onto the surface of a metal item to be hardfaced; c) driving of the water from the slurry with low heat to leave a deposit of dry alloy, binder and flux on the metal surface; and d) heating the entire metal item at a sufficiently high temperature to fuse the alloy and form a tightly bonded, hardface on the metal item. The method of the present invention is an improvement over Alessi and the hardfacing methods in current use based on Alessi, e.g., the process referred to as "Dura-Face" in U.S. Pat. No. 5,456,323.

In the methods of the art for hardfacing based on Alessi, the flux and binder combination (flux/binder) used to prepare the coating slurry melts into a liquid at a much lower temperature than the melting point of the alloy powder content of the slurry. The flux/binder continues to exist as a liquid, even at the higher temperature of fusion of the alloy powder. However, the liquid flux/binder cannot rise to the surface of the molten alloy completely within the brief time of fusion and before the metal solidifies. Therefore, the flux/binder is trapped as small, nonmetallic particles known as "inclusions" within the alloy-coating. The inclusions are relatively soft and brittle, thus, weaken the alloy coating and reduce its resistance to wear. Even if sufficient time is allowed for the liquid flux/binder to rise through the molten alloy layer, the flux/binder will not be removed from the coating but will form a part of the coating top layer.

Further, because the melting point of the flux/binder is well below that of the coating alloy, the flux/binder becomes a low viscosity fluid well before the fusion temperature of the alloy is reached. Here the term "fusion" is taken to mean that the finely divided alloy becomes soft and the individual particles melt and agglomerate to form a continuous coat. The fluid flux/binder tends to flow easily on nonhorizonal surfaces carrying with it some of the alloy powder well before the fusion of alloy powder begins to occur. Thus, the melting of the flux/binder results in nonuniform thickness of the solidified coating causing poor wear performance of the alloy coating.

In the first embodiment of the present method, an aqueous solution of polyvinyl alcohol (PVA) is used as the binder in an aqueous slurry of an alloy without a flux. PVA when heated does not melt to a thermoplastic, but decomposes by loss of water from two adjacent hydroxyl groups at temperatures above 150° C. When the alloy/PVA coating is heated to the alloy fusion temperature, the PVA nearly completely evaporates from the coating leaving behind an agglomerate of clean alloy coating powder particles with sufficient cohesive strength that fuses into a clean and dense metallic coating without inclusions.

However, because PVA decomposes and escapes well below the fusion temperature of a hardfacing alloy powder, it does not protect the alloy as it reaches the fusion temperature from chemically reacting with gases of the atmosphere, e.g., oxygen, nitrogen, and carbon dioxide. Such protection is a purpose of a flux material, which is intentionally omitted in the present invention. Therefore, a protective atmosphere is preferably provided during heating, fusion, and cooling where the alloy at elevated temperature is air sensitive.

In a laboratory and on a small scale, fusion of an alloy conveniently can be carried out in a high vacuum (about $10^{-4}$ torr or 0.1 $\mu$m) furnace, effectively eliminating atmospheric gases. Low pressure (100–200 $\mu$m) inert gas, e.g., argon or helium, furnace operation is also suitable. At low pressures, nitrogen also can be used though not as satisfactorily as argon or other inert gases. However, high vacuum and low pressure inert gas operations in a vacuum furnace in a production environment are relatively expensive and slow. Inert gases, i.e., argon and helium, just above atmospheric pressure, and reducing gases, such as hydrogen, just above atmospheric pressure can be used as a protecting atmosphere during alloy fusion at an acceptable production rate. Hydrogen, because it is less expensive than argon or helium, is preferred as a protecting atmosphere in large scale production. Furnaces that use hydrogen as a protecting atmosphere are known in the art of metallurgy and are commercially available.

A slurry used in the present invention is prepared by thoroughly mixing a powdered, hardfacing alloy with a PVA binder solution to give the desired alloy to binder solution weight ratio. The slurry compositions described herein are designated by an eight-digit code. For example, for a "0550/0750" slurry, the first four digits, "0550", indicate a 5.5 to 1 weight ratio of powdered alloy to PVA solution and the last four digits, "0750", indicate a 7.5% (by weight) aqueous solution of PVA as a binder. In this designation, the decimal point is assumed to occur in the middle of each four digit group. Likewise, "1075/1025" means a ratio of alloy to PVA of 10.75 to 1, and the aqueous solution of PVA is 10.25% PVA, by weight, in water.

Those skilled in the art of metallurgy will appreciate that to obtain a uniform wear-resistant coating, a metal surface to be hardfaced should be clean, bare metal that is free of oxide. Preferably, prior to employing the hardfacing methods taught herein, the metal surface to be hardfaced has been prepared by cleaning to bare metal. Conveniently, a metal surface may be prepared for hardfacing by scrubbing with hot detergent and then grit blasting. Preferably, the grit is about 80 to about 120 mesh. If only a few items are to be coated, the surface may be freed of oxide by rubbing with fine abrasive paper or cloth, e.g., 120 grit abrasive paper or cloth. The grit material may be substantially any hard angular particle powder, e.g., alumina, "steel grit," and many other commercially available abrasives.

In the first embodiment of the method of the present invention, the preferred procedure for applying a slurry to a metal surface to be coated depends on the shape and size of the metal item having the metal surface as well as the ratio of alloy and the concentration of the PVA binder solution. Typically, the coating slurry is poured, brushed, or sprayed on the metal surface to be protected, or the item having the metal surface to be protected can be dipped into the slurry. This procedure is useful for relatively thin coatings, e.g., up to about 0.030 in (0.75 mm), but uniformity of coating thickness is sometimes difficult to obtain and maintain. For this procedure, preferably the ratio of alloy to PVA solution is in the range of about 4:1 to about 8:1 and the concentration of PVA solution is about 1% to about 15% PVA by weight. For example, 0500/0500, 0600/0150, 0700/0150, 0500/0750, 0600/0750 or similar slurries are suitable for this procedure.

Spray coating requires a slurry which has a slow sedimentation rate of alloy powder. According to Stoke's law the terminal velocity (i.e. velocity without acceleration), "Vt," of a powder particle through a column of fluid is directly proportional to the square of the radius, "r", of the particle assumed to be spherical and inversely proportional to the viscosity of the fluid medium, "ρ", i.e., $Vt \propto r^2/\rho$. Therefore, the smaller the mesh size of an alloy powder and the higher the viscosity of the binder, the slower the sedimentation rate of the alloy powder. The radius term because it is squared, has a stronger effect than viscosity on the sedimentation rate. For example, the radius of 200 and 325 mesh particles are 75$\mu$ and 45$\mu$ respectively and the viscosities of 5% and 7.5% PVA solutions are 15 mPa.s and 70 mPa.s. The Vt value for a 325 mesh particle in 7.5% PVA binder will then be 13 times lower than that of a 200 mesh particle in 5.0% PVA solution. The sedimentation rate can therefore be controlled by judiciously choosing combinations of binder concentration and powder particle size. For example, the settling of alloy powder in an unstirred 0500/0750 slurry of minus 200 mesh powder is negligible after 20 minutes.

A higher concentration of binder, e.g., 10% (binder viscosity 250 mPa.s), will further reduce the settling rate, but the corresponding large increase in the slurry viscosity would make the slurry unsuitable for spraying. However, a high viscosity slurry might be used for alternate application procedures, i.e., pastes and tapes, taught hereinbelow.

Thick slurry compositions, i.e., a high ratio of alloy to PVA solution, can be applied as a squeezable paste, or can be rolled into tapes for bonding to the metal surface. Both these procedures, however, usually require special additives to function as dispersants, deflocculants, and plasticizers. For these procedures, preferably the ratio of alloy to PVA solution is in the range of about 8:1 to about 15:1 by weight and the concentration of PVA solution is about 6% to about 15% PVA by weight. Typical examples of thick slurries are 1000/1000, 1200/1500, and 1500/1200. The paste and tape methods can be used for thick coatings. However, these procedures are difficult to adapt to a high speed production environment.

When a thick coating is desired, a reliable and economical alternative to paste and tape is a multiple coating procedure which produces uniformly thick slurry coatings even on large surfaces. The required thickness can be built by repeated spraying with intervening drying cycles. The drying may be done at about 80° to about 120° C. in a forced circulation air oven. A 0500/0750 slurry is particularly suitable for this method though other formulations may be used.

The method of the present invention is particularly useful for hardfacing surfaces of steel items subject to high impact, corrosion, and abrasive wear including, but not limited to, tools (especially cutting edges of tools), bearings, pistons, crankshafts, gears, machine parts, firearms, farm implements, and surgical instruments. The method may be used for hardfacing ductile iron and gray iron, often used in cast items such as engine blocks and assembly housings. An alloy may be fused onto the surface of a cast iron item at a temperature just below the melting point of the iron item. Further, the methods of the present invention may be used to coat nonferrous metals and alloys provided the hard surfacing alloy is compatible with the metal surface being coated and the fusion temperature of the hard surfacing alloy is significantly below the melt point of the metal being hardfaced.

Alternatively, using the second embodiment of the present invention the metal surface to be protected can be coated with an aqueous PVA solution (about 1% to about 15% PVA by weight) to form a binder coating followed by distributing dry powder alloy onto the PVA binder solution coating while it is still wet, preferably with a powder sprayer and most preferably with an air sprayer. Preferably, both the aqueous PVA solution and the alloy powder are sprayed onto the metal surface. The PVA binder solution is then dried to yield a solid layer of alloy powder bound to the surface by a coating of PVA. Multiple layers of alloy powder can be obtained by applying successive coatings of PVA solution and layers of alloy powder and drying each successive PVA solution coating binding an alloy layer before adding another PVA coating. This embodiment eliminates the problems of powder sedimentation in a slurry and slurry flow in thick coatings. Further, this embodiment is well suited for high speed production.

Heat treating metal to modify or enhance its properties is well known and widely practiced in the art of metallurgy, i.e., see *Heat Treating Handbook,* ASM International, Metals Park, Ohio (1991). The process of heat treating essentially involves uniformly heating the metal to its austenitizing (quenching) temperature then quickly cooling, i.e., quenching, in a quenching medium, such as water, quenching oil, or a polymer quenchant, or even air. A metal item having a surface hardfaced by the method of the present invention may be heat treated by removing the item from the furnace after fusing of the alloy, cooling slowly to the metal's quenching temperature, and then quickly immersing it in a suitable quenching medium. Alternatively, a metal item having a surface previously hardfaced can be heat treated by heating to its quenching temperature and quenching.

A PVA binder, unlike the flux/binders taught in the art, does not melt to form a liquid before or during the coating fusion process and hence does not provide an opportunity for the coating powder to "travel" before the powder begins to fuse. This property of PVA assures that the final fused coating thickness corresponds to the starting slurry coating thickness at every location of the coating. Slurries up to 0.040 inch thick fused on a vertical steel surface showed no displacement of powder metal, before or during fusion. Up to 0.060 inch (1.5 mm) thick coating on a 60 degree inclined surface also showed no metal flow. Thus, PVA, as a binder minimizes the coating nonuniformity problem found in hardfacing processes of the art.

Revankar, et al., in U.S. Pat. No. 5,027,878, employ PVA, in the evaporative pattern casting or EPC process, as a means to hold ceramic particles, such as particles of a metal carbide, in place on a polymer pattern which is then placed in a sand mold into which molten iron is being cast. However, '878 teaches the ceramic particles being impregnated into the iron and not fused onto a metal surface as are the alloy particles in the method of the present invention. Further, '878 teaches ceramic particle size preferably of about 30 mesh; most preferable, about 100 mesh, while the alloy particles of the present invention are preferably about 200 mesh or finer.

PVA, the binder used in the present invention, is an inexpensive and environmentally safe polymer. In absence of acids or bases, an aqueous solution of PVA is stable even after several months of storage at room temperature. The stability of PVA solutions is an advantage for production applications. When an alloy powder slurry with PVA as binder is heated to the alloy powder fusion temperature in a protective atmosphere such as argon or helium or in a reducing atmosphere such as hydrogen, PVA appears to evaporate completely, resulting in a dense coating of alloy without inclusions.

An alloy useful in the present invention is substantially harder and more wear-resistant than the steel typically used for tools, gear, engine parts, and farm implements, e.g., 1045 grade steel. Preferably, the alloy has a Knoop hardness value in the range of about 800 to about 1300. The alloy has a fusion temperature of about 1100° C. or less, e.g., which is lower than the melting point of the metal that it to be coated. Preferably the alloy powder has a sufficiently small particle size to form a uniform slurry and uniform hardfacing. Preferably, the alloy is single phase, and, preferably, has a fusion temperature between about 900° C. and about 1200° C. It is in the form of a finely divided powder having particles typically ranging in size from about 90 mesh to about 400 mesh. Preferably the average particle size is finer than about 200 mesh and most preferably, finer than about 325 mesh.

Alloys useful in the present invention are preferably at least 60% of a transition metal of Group 8 of the Periodic Table, such as iron, cobalt, or nickel, i.e., they are iron, cobalt, or nickel based, but may be based on other metals so long as the alloys have the physical properties stated above. Minor components (about 0.1 to about 20%) typically are boron, carbon, chromium, iron (in nickel and cobalt-based alloys), manganese, nickel (in iron and cobalt-based alloys), silicon, tungsten, or combinations thereof, see Alessi. Elements in trace amounts (less than about 0.1%), such as sulfur, may be present as de minimis, contaminants. Although it may be possible to prepare an alloy containing radioactive, highly toxic, or precious elements that meets the required physical and chemical properties cited above, such an alloy may be of limited value or no practical value because of the health, safety and/or economic considerations.

Methods of preparing finely powdered alloys are well known in the art of metallurgy. Information and background on powdered alloys useful for the present invention can be found in standard text books teaching the art such as, Hausner, H. H. and Mal, M. K., *Handbook of Powdered Metallurgy,* 2nd Ed., (especially starting at page 22) Chemical Publishing Co., Inc. (1982). Powdered alloys useful in the present invention are available from commercial suppliers, such as Wall Colmonoy Corporation, Madison Heights, Mich. and SCM Metal Products, Inc., Research Triangle Park, N.C.

The following examples are presented to further illustrate the present invention and are not to be construed as limitations thereof.

EXAMPLES

Example 1. Alloys

Alloys useful in the methods of the present invention include but are not limited to those described in table 1.

TABLE 1

Elemental Composition (weight percent) of Selected Alloys Useful for Hardfacing Metal Surfaces

| Element | Alloy #1 % | Alloy #2 % | Alloy #3 % | Alloy #4 % |
|---|---|---|---|---|
| Boron | 3.00 | 3.29 | 3.08 | 2.00 |
| Carbon | 0.70 | 2.18 | 1.98 | 0.60 |
| Chromium | 14.30 | 14.44 | 14.12 | 12.35 |
| Cobalt | — | — | — | balance |
| Iron | 4.00 | balance | balance | 1.30 |
| Manganese | — | 0.31 | 0.50 | — |
| Nickel | balance | 5.72 | 5.64 | 23.5 |
| Silicon | 4.25 | 3.09 | 2.74 | 1.90 |
| Tungsten | — | — | — | 7.60 |

Example 2. Applying a Wear-resistant Coating to a Sweep under Argon

Polyvinyl alcohol (PVA) (75-15 Elvanol (trademark) supplied by DuPont) is mixed with sufficient water to make a 7.5 weight % PVA solution. Alloy #3 (see Table 1, Example 1) powder averaging about 200 mesh, supplied by SCM Metal Products, Inc., is added to the PVA solution in the weight ratio of 5.0 parts alloy #3 to 1 part PVA solution to make a slurry of the type 0500/0750.

A sweep is scrubbed with hot detergent solution, and the area to be coated is grit blasted to a dull finish with 100 mesh grit. A 2 mm thick layer of the alloy / PVA slurry is sprayed onto the area of the sweep to be coated, and the sweep is heated in a forced circulation oven at about 120° C. for 30–60 minutes until the slurry has dried to form an alloy / PVA deposit. The sweep is then transferred to a vacuum furnace operating with a 100–500 micron partial pressure of argon. The sweep is heated to approximately 1100° C. and held at that temperature until the fusion of the coating to the surface of the sweep is complete (about 2 to 10 min). The sweep is then slowly and uniformly cooled while maintaining the argon atmosphere until the temperature reaches about 300° C. or lower at which time the sweep is removed from the furnace and allowed to cool to ambient temperature. (As used herein "ambient temperature" is synonymous with "room temperature", i.e., about 15° C. to about 35° C.)

Example 3. Applying a Wear-resistant Coating to a Sweep under Hydrogen

A wear-resistant coating is applied to a sweep as in Example 2 except it is heated in a vacuum furnace under hydrogen at a slightly positive pressure (about 1 to about 2 psig).

Example 4. Heat Treatment of a Metal Substrate

A wear-resistant coating is applied to a sweep as in Example 2. The sweep is then reheated to the austenitizing, (quenching), temperature of the substrate steel (e.g., 845° C. for 1045 steel) then quenched in a commercially available quenching oil. The sweep is then reheated to about 275° C. to 300° C. to temper the martensite formed by quenching, and allowed to cool to ambient temperature in the air.

Example 5. Applying a Wear-resistant Coating to a Rasp Bar of a Grain Combine A wear-resistant coating is applied to a rasp bar surface by spraying onto the cleaned surface an alloy #2 (Table 1, Example 1) slurry, i.e., the alloy weight to PVA solution weight ratio is 6.0:1, and the aqueous PVA solution is 5.0% PVA to form a 0600/0500 type of slurry. After drying the slurry onto the rasp bar in a manner similar to the procedure of Example 2, the alloy is fused onto the rasp bar in a belt type furnace under a positive pressure hydrogen atmosphere at about 1100° C. The coated rasp bar is then cooled to the quenching temperature which is selected according to the substrate steel grade as mentioned in Example 4 above and then quenched in a commercially available oil or a polymer quenchant depending on the steel grade. The quenched rasp bar then may be further heat treated as in Example 4.

Example 6. Applying a Wear-resistant Coating to the Edge of a Lawn Mower Blade A lawn mower blade is hardfaced with a wear-resistant coating according to the procedure of Example 2, except alloy #1 (Table 1, Example 1) is used in place of alloy #3. It is then heat treated as in Example 4.

Example 7. Applying a Wear-Resistant Coating to an Agricultural Combine Feeder House Retainer Casting Made from Ductile Iron The retainer housing surface is prepared to receive a wear resistant coating as in Example 2. The part to be hardfaced is then sprayed with a 10% aqueous PVA solution. Immediately, the area covered with the PVA solution is sprayed with alloy #4 (Table 1, Example 1) and the housing is heated in a forced circulation air oven to about 120° C. until the PVA binding coating has dried to form an alloy/PVA deposit. The area of the part not to be hardfaced is wiped free of PVA binder and alloy. Note that in this second embodiment of the method of the present invention, there is no need to form a slurry before application of alloy powder.

The housing is then heated to temperatures of about 1100° C. for fusing the coating. The heating is done in a belt type conveyor furnace in a positive pressure (approximately 1 to 2 psig) of hydrogen, and the retainer housing is held at about 1065° C. to about 1075° C. for approximately 2–5 minutes. The housing is then transferred to an austempering salt bath heated to about 275° C. to about 325° C., and held in the bath for 4 to 6 hours at that temperature until the material structure transformation is complete. It is then removed from the bath and cooled in air to ambient temperature.

I claim:

1. A method for hardfacing a metal surface with a wear-resistant coating comprising the steps of:

a) forming a substantially uniformly thick, aqueous slurry without flux consisting essentially of polyvinyl alcohol, a fusible, hard metal alloy with at least 60% iron in the from of a finely divided powder, and, one or more non-flux additives selected from the group consisting of dispersants, deflocculants and plasticizers;

b) coating the metal surface with the thick, aqueous slurry;

c) drying the thick, aqueous slurry to form a solid layer of the fusible, hard metal alloy and one or more non-flux additives in a polyvinyl alcohol matrix on the metal surface;

d) heating the metal surface coated with the layer of fusible, hard metal alloy in the polyvinyl alcohol matrix to the fusing temperature of the alloy in a protective atmosphere at a pressure of between $10^{-4}$ torr and 2 psig until the alloy has fused onto the metal surface; and e) cooling the metal surface with the fused hardfacing to ambient temperature.

2. A method for hardfacing a metal surface with a wear-resistant coating comprising the steps of:

a) forming a substantially uniformly thick, aqueous slurry without flux consisting essentially of polyvinyl alcohol, a fusible, hard metal alloy with at least 60% iron in the form of a finely divided powder, and, one or more non-flux additives selected from the group consisting of dispersants, deflocculants and plasticizers;

b) coating the metal surface with the thick, aqueous slurry;

c) drying the thick, aqueous slurry to form a solid layer of the fusible hard metal alloy and one or more non-flux additives in a polyvinyl alcohol matrix on the metal surface;

d) heating the metal surface coated with the layer of fusible, hard metal alloy in the polyvinyl alcohol matrix to the fusing temperature of the alloy in a protective atmosphere until the alloy has fused onto the metal surface; and e) cooling the metal surface with the fused hardfacing to ambient temperature.

3. The method of claim 2 wherein the alloy is heated to fusing temperature under a hydrogen atmosphere.

4. The method of claim 2 wherein the alloy consists essentially of one or more elements selected from iron, nickel, and cobalt, and two or more elements selected from boron, carbon, chromium, molybdenum, manganese, tungsten, and silicon.

5. The method of claim 2 wherein the metal surface is on an agricultural implement.

6. The method of claim 2 wherein the alloy is heated to fusing temperature under an argon atmosphere.

7. A method for hardfacing a metal surface with a wear-resistant coating comprising the steps of:

a) coating the metal surface with an aqueous polyvinyl alcohol solution;

b) distributing a substantially uniform layer of a fusible, hard metal alloy with at least 60% iron in the form of a finely divided powder without flux onto the coating of the polyvinyl alcohol solution applied in step a before the polyvinyl alcohol solution dries;

c) drying the aqueous polyvinyl alcohol solution coating to form a solid layer of the fusible, hard metal alloy bonded to the metal surface by the coating of polyvinyl alcohol;

d) heating the metal surface coated with the layer of fusible, hard metal alloy bonded by the coating of polyvinyl alcohol to the fusing temperature of the alloy in a protective atmosphere until the alloy has fused; and e) cooling the metal surface with the fused hardfacing to ambient temperature.

8. The method of claim 7 wherein the hard metal alloy in the form of a finely divided powder is distributed by a powder sprayer.

9. The method of claim 7 wherein steps a, b, and c are repeated at least once.

10. The method of claim 7 wherein the alloy is heated to fusing temperature under a hydrogen atmosphere.

11. The method of claim 7 wherein the alloy consists essentially of one or more elements selected from iron, nickel, and cobalt, and two or more elements selected from boron, carbon, chromium, molybdenum, manganese, tungsten, and silicon.

12. The method of claim 7 wherein the metal surface is on an agricultural implement.

13. The method of claim 7 wherein the alloy is heated to fusing temperature under an argon atmosphere.

* * * * *